US005516449A

United States Patent [19]

Agar et al.

[11] Patent Number: 5,516,449

[45] Date of Patent: May 14, 1996

[54] DETERGENT COMPOSITIONS

[75] Inventors: Joseph T. H. Agar; Richard T. Hartshorn, both of Newcastle upon Tyne; Graham A. Sorrie, Northumberland, all of Great Britain

[73] Assignee: The Procter & Gamble Company, Cincinnati, Ohio

[21] Appl. No.: 313,226

[22] PCT Filed: Mar. 29, 1993

[86] PCT No.: PCT/US93/02945

§ 371 Date: Apr. 28, 1995

§ 102(e) Date: Apr. 28, 1995

[87] PCT Pub. No.: WO93/20172

PCT Pub. Date: Oct. 14, 1993

[30] Foreign Application Priority Data

Apr. 3, 1992 [GB] United Kingdom ..... 9208062

[51] Int. Cl.[6] ..... C11D 3/32; C11D 3/395; C11D 11/00; C11D 17/06

[52] U.S. Cl. ..... 252/102; 252/90; 252/99; 252/174; 252/174.13; 252/174.25; 252/186.26

[58] Field of Search ..... 252/90, 99, 102, 252/174, 174.13, 174.25, 186.26

[56] References Cited

U.S. PATENT DOCUMENTS

| | | | |
|---|---|---|---|
| 4,483,781 | 11/1984 | Hartman | 252/174 |
| 4,925,585 | 5/1990 | Strauss | 252/89.1 |
| 5,049,298 | 9/1991 | Ploumen | 252/95 |
| 5,055,218 | 10/1991 | Getty | 252/94 |
| 5,098,598 | 3/1992 | Sankey | 252/186.42 |

*Primary Examiner*—Dennis Albrecht

*Attorney, Agent, or Firm*—Michael D. Jones; Jerry J. Yetter; Jacobus C. Rasser

[57] ABSTRACT

Detergent compositions containing amide substituted peroxyacid bleaching compounds are provided in which at least 60% of the originally added peronacid bleach remains after 28 days storage at 32° C. and 80° RH. The compositions contain at least one multi-ingredient component and have a density in excess of 650 g/liter, a total Iron, Manganese and Copper content of less than 40 ppm, an Equilibrium Relative Humidity at 32° C. of less than 30% and preferably a sodium sulphate content of less than 2.5 % by weight.

24 Claims, No Drawings

DETERGENT COMPOSITIONS

This invention relates to laundry detergent compositions containing one or more amide substituted peroxyacid bleaching compounds and more especially to solid laundry detergent compositions containing such compounds.

The use of amide substituted peroxyacid-bleaching compounds in detergent compositions has been disclosed in, for example, EP-A-0170386. These bleaching compounds perform well over wide temperature and pH ranges and are effective at removing hydrophobic soils including body soils and greasy soils from fabrics to provide overall good dingy fabric cleaning. Their use in detergent compositions is complemented by the presence of one or more additional bleaching components such as peroxy acid bleach precursors (bleach activators) which typically give effective removal of hydrophilic stains including tea, wine and coffee.

The Applicants have now discovered that such amide substituted peroxyacid bleaching compounds are particularly suitable for inclusion in laundry compositions formulated for use in the cleaning of coloured fabrics. Their suitability for this purpose arises from their unexpected lack of propensity to cause colour damage to such fabrics during the wash process and their ability to limit fabric malodour caused by microbial spoilage. Furthermore, these 'colour-safe' bleaches have also been found to give surprisingly good performance under conditions of high pH (>10.5) and water hardness (>12° Clark hardness).

However, the inclusion of peroxyacid bleaching compounds in detergent compositions has been restricted hitherto by the relative instability of these compounds both as is and in use. Peroxyacid bleaching compounds lose available oxygen at a significant rate in the presence of free ions of heavy metals such as iron, copper and manganese and also in the presence of moisture, these effects being accelerated at temperatures in excess of about 30° C.

Moisture and free heavy metal ions are unavoidable components of conventional granular detergent compositions. The presence of these components has resulted in only marginally acceptable peroxyacid bleaching compound stability when in such compositions under Northern European summer conditions, where the average maximum temperature over the hottest months is from 21° C. to 25° C. Unacceptable stability is obtained under temperatures higher than this such as are found in the Middle East and Southern Asia and also in Southern Europe where average maximum temperatures are in the 27° C. to 33° C. range for the hottest summer months.

Attempts have been made to increase the stability of peroxyacid bleaching compounds when in detergent formulations with the aim of making them viable components of such formulations. These attempts have tended to concentrate on the protection of the peroxyacid bleaching compounds by coating the crystalline product or by inclusion of stabilising agents during its manufacture, or both.

Phosphate builders may act as heavy metal ion sequestrants, a property which tends to mitigate peroxyacid bleaching compound decomposition in phosphate-built detergent products. The problem of low peroxyacid bleaching compound stability is by contrast particularly significant in compositions which contain only non-phosphate builder systems where the builder compounds may not show great heavy metal ion sequestration ability. Phosphate is often excluded from detergent compositions for reasons of environmental concern.

While it has proved possible to incorporate peroxyacid bleaching compounds in conventional detergent compositions so as to have acceptable peroxyacid bleach stability, over periods reflecting normal product shelf life, these compositions have proved complex and expensive to manufacture. This has restricted their broadscale utilisation, as evidenced by the small number of commercially available products containing peroxyacid bleaching compounds.

Peroxyacid bleaching compounds may be incorporated into detergent compositions by dry addition of the bleaching compound to the remainder of the particulate components towards the end of the detergent manufacturing process. In conventional detergent processing the bulk of these particulate components are in the form of spray-dried granules. The requirements for making spray-dried granules of the required density, particle flow and solution characteristics are such that little or no scope for modifying the basic nature of these granules has been possible.

The Applicants have now discovered that the formulation and processing of certain so-called 'concentrated' products of higher ingredient activity can be arranged so that the constraints applying to spray-dried granular products can be significantly reduced, if not overcome completely. This, in turn, has permitted the formulation of particulate laundry detergent products containing peroxyacid bleaching compounds with no, or only basic, coating/stability agents, in which the peroxyacid bleaching compounds have an acceptable stability over a period of time corresponding to the normal shelf life of the products.

It is therefore an object of the present invention to provide a concentrated particulate laundry detergent composition incorporating one or more amide substituted peroxyacid bleaching compounds, said bleaching compounds displaying acceptable storage stability, together with satisfactory particle flow and solubility characteristics over the expected normal shelf life of the composition in the trade and in particular when stored under conditions of high ambient temperatures such as are experienced in equatorial geographies during the summer months.

It is also an object of the present invention to provide a concentrated particulate laundry detergent composition incorporating one or more amide substituted peroxyacid bleaching compounds displaying acceptable storage stability, in which the peroxyacid bleaching compounds do not require complex protection techniques.

It is a further object of the present invention to provide a concentrated particulate laundry detergent composition incorporating one or more amide substituted peroxyacid bleaching compounds which is particularly suitable for the 'colour-safe' laundering of coloured fabrics over a range of pH and hardness conditions.

According to the present invention there is provided a solid laundry detergent composition, comprising by weight:

a) from 5% to 30% of one or more suffactants;

b) from 15% to 80% of one or more non-phosphate detergent builder salts;

c) from 1% to 15% of one or more bleaching compounds which provide in an aqueous solution an amide substituted peroxyacid bleaching compound of the formula:

$$R^1-\underset{\underset{O}{\|}}{C}-\underset{\underset{R^5}{|}}{N}-R^2-\underset{\underset{O}{\|}}{C}-OOH \text{ or } R^1-\underset{\underset{R^5}{|}}{N}-\underset{\underset{O}{\|}}{C}-R^2-\underset{\underset{O}{\|}}{C}-OOH$$

wherein $R^1$ is an alkyl, aryl or alkaryl group containing from 1 to 14 carbon atoms, $R^2$ is an alkylene, arylene or alkarylene group containing from 1 to 14 carbon atoms, and $R^5$ is H or an alkyl, aryl or alkaryl group containing from 1 to 10 carbon atoms;

d) from 0% to 30% of additional bleaching components selected from oxygen bleaches, peroxyacid bleach precursors and photoactivated bleaches;

e) from 0% to 67% of detergent ingredients other than those in a) to d)

wherein the composition i) has a bulk density of at least 650 g/liter, and comprises at least one multi-ingredient component;

ii) contains less than 40 ppm total of free Iron, Copper and Manganese ions; and iii) has an Equilibrium Relative Humidity of not more than 30% at 32° C., whereby the weight percentage of the original bleaching compound (c) remaining undecomposed after 28 days storage in closed wax laminated paperboard cartons at 32° C. and 80% Relative Humidity is at least 60%.

Preferably the Equilibrium Relative Humidity is no more than 25% by weight at 32° C. The Equilibrium Relative Humidity reflects the level of active moisture in the composition.

For the purposes of the present invention, Equilibrium Relative Humidity is measured as follows: 300 g of product is placed in a 1 liter container made of a water impermeable material and fitted with a lid capable of sealing the container. The lid is provided with a sealable hole adapted to allow insertion of a probe into the container interior. The container and contents are maintained at a temperature of 32° C. for 24 hours to allow temperature equilibration. A solid state Hygrometer (Hygrotest 6100, marketed by Testoterm Ltd, Old Flour Mill, Queen Street, Emsworth, Hampshire, England) is used to measure the water vapour pressure in the space over the products. Whilst the container is maintained at 32° C., the probe is inserted through the hole in the lid and measurements of the water vapour pressure are made at ten minute intervals until the vapour pressure has equilibrated, as evidenced by no change in two successive readings. The instrument converts the water vapour pressure measurement into a direct read-out of the Equilibrium Relative Humidity.

In a preferred embodiment of the invention, one multi-ingredient component comprises an agglomerate of non-spray-dried ingredients together with a second multi-ingredient component comprising a spray-dried powder.

The first essential component of the detergent compositions in accord with the invention is a surfactant system comprising one or more surfactants. A wide range of surfactants can be used in the detergent compositions. A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Mixtures of anionic surfactants are suitable herein, particularly blends of sulphate, sulphonate and/or carboxylate surfactants. Mixtures of sulphonate and sulphate surfactants are normally employed in a sulphonate to sulphate weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical and the alpha-sulphonated methyl fatty acid esters in which the fatty acid is derived from a $C_{12}$–$C_{18}$ fatty source, preferably from a $C_{16}$–$C_{18}$ fatty source. In each instance the cation is an alkali metal, preferably sodium. Preferred sulphate surfactants in such sulphonate sulphate mixtures are alkyl sulphates having from 12 to 22, preferably 16 to 18 carbon atoms in the alkyl radical. Another useful surfactant system comprises a mixture of two alkyl sulphate materials, whose respective mean chain lengths differ from each other. One such system comprises a mixture of $C_{14}$–$C_{15}$ alkyl sulphate and $C_{16}$–$C_{18}$ alkyl sulphate in a weight ratio of $C_{14}$–$C_{15}$:$C_{16}$–$C_{18}$ of from 3:1 to 1:1. The alkyl sniphates may also be combined with alkyl ethoxy sulphates having from 10 to 20, preferably 10 to 16 carbon atoms in the alkyl radical and an average degree of ethoxylation of 1 to 6. The cation in each instance is again an alkali metal, preferably sodium.

Other anionic surfactants suitable for the purposes of the invention are the alkali metal sarcosinates of formula

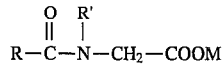

wherein R is a $C_9$–$C_{17}$ linear or branched alkyl or alkenyl group, R' is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5 in which the hydrophobic (lipophilic) moiety may be aliphatic or aromatic in nature.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

A further preferred class of nonionic surfactants comprises polyhydroxy fatty acid amides of general formula

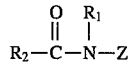

wherein $R_1$ is H, a $C_1$–$C_4$ hydrocarbyl, 2 hydroxyethyl, 2-hydroxypropyl or mixtures thereof, $R_2$ is a $C_5$–$C_{31}$ hydrocarbyl and Z is a polyhydroxyhydrocarbyl having a linear hydrocarbyl chain with at least three hydroxy groups directly connected to the chain, or an alkoxylated derivative thereof. In preferred members of this class the polyhydroxy hydrocarbyl moiety is derived from glucose or maltose or mixtures thereof and the $R_2$ group is a $C_{11}$–$C_{19}$ alkyl or alkenyl. Highly preferred compounds utilise a $C_{15}$–$C_{19}$ alkyl moiety as the $R_1$ group. Compositions incorporating such highly preferred polyhydroxy fatty acid amides are disclosed in the copending British Application No. 9113139 filed Jun. 18, 1991.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides, where in this case 'short chain' means no more than 6 carbon atoms in the chain. Compounds of this type and their use in detergent compositions are disclosed in EP-B-0070074, 0070077, 0075996 and 0094118.

A further class of surfactants are the semi-polar surfactants such as amine oxides. Suitable amine oxides are selected from mono $C_8$–$C_{20}$, preferably $C_{10}$–$C_{14}$ N-alkyl of alkenyl amine oxides and propylene-1,3-diamine dioxides wherein the remaining N positions are substituted by methyl, hydroxyethyl or hydroxypropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The detergent compositions comprise from 5% to 30% of suffactant but more usually comprise from 7% to 20%, more preferably from 10% to 15% by weight of the composition.

Combinations of surfactant types are preferred, more especially anionic-nonionic and also anionic-nonionic-cationic blends. Particularly preferred combinations are described in GB-A-2040987, GB-9113139 and EP-A-0087914. Although the surfactants can be incorporated into the compositions as mixtures, it is preferable to control the point of addition of each surfactant in order to optimise the physical characteristics of the composition and to avoid processing problems. Preferred modes and orders of surfactant addition are described hereinafter.

The second essential component of compositions in accordance with the invention is a detergent builder system comprising one or more non-phosphate detergent builders. These can include, but are not restricted to alkali metal carbonates, bicarbonates, silicates, aluminosilicates, monomeric and oligomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates) and mixtures of any of the foregoing. The builder system is present in an amount of from 15% to 80% by weight of the composition, more preferably from 30% to 60% by weight.

Preferred builder systems are free of boron compounds and any polymeric organic materials are preferably biodegradable.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being preferred. These materials can be added at various points of the manufacturing process, such as in a slurry of components that are spray-dried or in the form of an aqueous solution serving as agglomerating agent for other solid components, or, where the silicates are themselves in particulate form, as solids to the other particulate components of the composition. However, for compositions in which the percentage of spray-dried components is low ie 30%, it is preferred to include the amorphous silicate in the spray-dried components.

Within the silicate class, highly preferred materials are crystalline layered sodium silicates of general formula $$NaMSi_xO_{2x+1.y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2,3 or 4 and is preferably 2. More preferably M is sodium and y is 0 and preferred examples of this formula comprise the α, β, δ, and γforms of $Na_2Si_2O_5$. These materials are available from Hoechst AG FRG as respectively NaSKS-5, NaSKS-7, NaSKS-11 and NaSKS-6. The most preferred material is γ-$Na_2Si_2O_5$, NaSKS-6. Crystalline layered silicates are incorporated either as dry mixed solids, or as solid components of agglomerates with other components.

Whilst a range of aluminosilicate ion exchange materials can be used, preferred sodium aluminosilicate zeolites have the unit cell formula.

$$Na_z[(AIO_2)_z(SiO_2)y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$,liter/minute/(g/liter) [2 grains Ca++/gallon/minute/(gram/gallon)] of aluminosilicate (anhydrous basis), and which generally lies within the range of from 130 mg equivalent of $CaCO_3$,liter/minute/(gram/liter) [2 grains/gallon/minute (gram/gallon)], to 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite P, Zeolite X, Zeolite HS and mixtures thereof. In an especially preferred embodiment, the crystalline aluminosilicate ion exchange material is Zeolite A and has the formula $$Na_{12}[(AIO_2)_{12}(SiO_2)_{12}].xH_2O$$

wherein x is from 20 to 30, especially 27. Zeolite X of formula $Na_{86}$ $[(AIO_2)_{86}(SIO_2)_{106}]$. 276 $H_2O$ is also suitable, as well as Zeolite HS of formula $Na_6[(AIO_2)_6(SiO_2)_6]7.5$ $H_2O$).

Suitable water-soluble monomeric and oligomeric carboxylate builders can be selected from a wide range of compounds but such compounds preferably have a first carboxyl logarithmic acidity constant ($pK_1$) of less than 9, preferably of between 2 and 8.5, more preferably between 4 and 7.5.

The logarithmic acidity constant is defined by reference to the equilibrium $$H^+ + A^- \leftrightarrows HA$$

where $A^-$ is the singly ionized anion of the carboxylate builder salt.

The equilibrium constant is therefore for dilute solutions given by the expression $$K_1 = \frac{[HA]}{[H^+][A^-]}$$

and $pK_1 = \log_{10} K_1$.

For the purposes of this specification, acidity constants are defined as 25° C. and at zero ionic strength. Literature values are taken where possible (see Stability Constants of Metal-Ion Complexes, Special Publication No. 25, the Chemical Society, London): where doubt arises they are determined by potentiometric titration using a glass electrode.

The carboxylate or polycarboxylate builders can be monomeric or oligomeric in type although monomeric carboxylates are generally preferred for reasons of cost and performance.

Monomeric and oligomeric builders can be selected from acyclic, alicyclic, heterocyclic and aromatic carboxylates having the general formulae

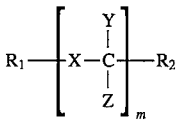

(a)

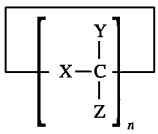

(b)

or

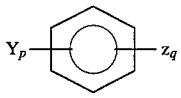

(c)

wherein $R_1$ represents H, $C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H,$C_{1-4}$ alkyl, alkenyl or hydroxy alkyl, or alkaryl, sulfo or phosphono groups;

X represents a single bond; O; S; SO; $SO_2$; or $NR_1$;

Y represents H; carboxy; hydroxy; carboxymethyloxy; or $C_{1-30}$ alkyl or alkenyl optionally substituted by hydroxy or carboxy groups;

z represents H; or carboxy;

m is an integer from 1 to 10;

n is an integer from 3 to 6;

p, q are integers from 0 to 6, p+q being from 1 to 6; and wherein, X, Y and Z each have the same or different representations when repeated in a given molecular formula, and wherein at least one Y or Z in a molecule contain a carboxyl group.

Suitable carboxylates containing one carboxy group include lactic acid, glycollie acid and ether derivatives thereof as disclosed in Belgian patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in British Patent No. 1,389,732, and aminosuccinates described in Netherlands application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, and the 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and-heterocyclic polycarboxylates include cyclopentane-cis, cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydrocarboxylates containing up to three carboxy groups per molecule, more particularly citrates.

The parent acids of the monomeric or oligomeric polycarboxylate chelating agents of mixtures thereof with their salts, eg citric acid or citrate/citric acid mixtures are also contemplated as components of builder systems useful in the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydfide, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorous compounds in the compositions is desired.

For the purposes of compositions in accordance with the invention, the non-phosphate builder ingredient will comprise from 15% to 80% by weight of the compositions, more preferably from 30% to 60% by weight. Within the preferred compositions, a sodium aluminosilicate such as Zeolite A will comprise from 20% to 60% by weight of the total amount of builder, a monomeric or oligomefic carboxylate will comprise from 10% to 30% by weight of the total amount of builder and a crystalline layered silicate will comprise from 10% to 65% by weight of the total amount of builder and a crystalline layered silicate will comprise from 10% to 65% by weight of the total amount of builder. In such compositions the builder ingredient preferably also incorporates a combination of auxiliary inorganic and organic builders such as sodium carbonate and maleic anhydride/acrylic acid copolymers in amounts of up to 35% by weight of the total builder.

The compositions of the present invention can be prepared in a variety of ways so as to display Equilibrium Relative Humidity of not more than the critical value of 30%. When the non-phosphate detergent builder is an alkali metal aluminosilicate zeolite the process conditions used in the preparation of the spray:dried powder component can be modified to lead to overdrying, by removal of the accessible water of the aluminosilicate zeolite. The modifications which may be made to the process conditions can include increasing the temperature in the spray-drying tower, typically by about 20° C., and/or increasing the residence time that the powder spends in the tower, typically by about 20%. Such overdried aluminosilicate zeolite in the spray-dried powder displays dessicant characteristics and may act as an in-built desiccant or 'moisture sink' when incorporated as a component of a detergent composition thereby leading to a composition of overall lower Equilibrium Relative Humidity. For this reason it is preferable that compositions in accord with the invention should maximise the amount of any aluminosilicate zeolite added in any spray-dried powder components.

It is, however, generally desirable that compositions in accord with the present invention contain no more than 35%, and preferably no more than 40%, by weight of spray-dried powder components. One of the factors dictating this preference is that spray-dried powders tend to be a source of free heavy metal ion contamination.

The third essential component of the detergent compositions of the invention is at least one bleaching compound or mixture of such compounds which provide in aqueous solution an amide substituted peroxyacid of the following general formulae:

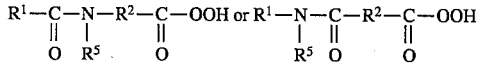

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analagous structural variations are permissible for $R^2$. The substitution can include alkyl, aryl, halogen, nitrogen, sulphur and other typical substituent groups of organic compounds. $R^5$ is preferably H or methyl. $R^1$ and $R^5$ should not contain more than 18 carbon atoms total.

The bleaching compounds or mixtures thereof are present in an amount of from 1% to 15% by weight, preferably from 1% to 8% by weight, and most preferably from 2% to 5% by weight of the composition.

The amide substituted peroxyacids provided in aqueous solution by the bleaching compounds of the invention provide effective and efficient surface bleaching of textiles which thereby removes stains and/or soils from the textiles. These peroxyacids are particularly efficient at removing dingy soils from textiles. Dingy soils are those that build up on textiles after much usage and washing, and result in a grey or yellow tinge on a white textile. These soils are a blend of particulate and greasy materials.

The amide substituted peroxyacids provided in aqueous solution by the bleaching compounds of the invention in addition provide effective bleaching over a wide range of temperature (5° C. to 85° C.), a preferred range being from about 30° C. to about 60° C. These peroxyacids also provide for 'colour-safe' laundering of coloured fabrics over a wide range of pH and hardness conditions.

Preferred examples of the bleaching compounds of the invention are simply the preformed peroxyacids of formulae

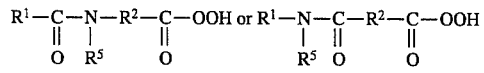

wherein $R^1$, $R^2$ and $R^5$ are as defined previously.

A further preferred group of bleaching compounds which provide the hereinbefore described amide substituted peroxyacids are the magnesium salts of the peroxyacids of the following general formulae:

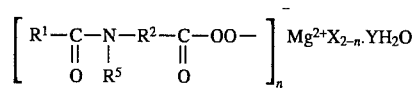

or

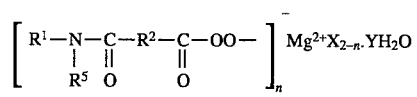

wherein $R^1$, $R^2$ and $R^5$ are as defined for the peroxyacid, X is a compatible anion, n is 1 or 2, and Y is from 0 to about 6.

The compounds are solid. The active oxygen in the magnesium peroxycarboxylate is readily available. This means that the solid magnesium peroxycarboxylates are readily soluble or dispersible and yield solutions containing peroxyacids. When the solution is aqueous, it cannot be distinguished from an aqueous solution prepared from the corresponding peroxyacid and an equivalent amount of magnesium, when the solutions are adjusted to the same pH.

The magnesium peroxycarboxylates can be prepared via the process of U.S. Pat. No. 4,483,781, Hartman, issued Nov. 20, 1984, incorporated herein by reference.

Preferred peroxyacid bleach precursors (bleach activators) which may provide the hereinbefore described amide substituted peroxyacids are amide substituted compounds of the general formulae:

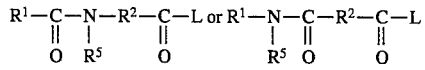

wherein $R^1$, $R^2$ and $R^5$ are as defined for the peroxyacid, and L can be essentially any suitable leaving group. A leaving group is any group that is displaced from the peroxyacid bleach precursor as a consequence of the nucleophilic attack on the peroxyacid bleach precursor by the perhydroxide anion. This, the perhydrolysis reaction, results in the formation of the peroxycarboxylic acid. The perhydroxide anion is provided by a suitable oxygen bleach the presence of which is necessary when such peroxyacid bleach precursor compounds are employed. Preferred examples of oxygen bleaches are described hereinafter.

Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (eg, a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behaviour are those in which their conjugate acid has a pKa in the range of from about 4 to about 13, preferably from about 6 to about 11 and most preferably from about 8 to 11.

Preferred peroxyacid bleach precursors in accord with this aspect of the invention are those of the above general formula wherein $R^1$, $R^2$and $R^5$ are as defined for the peroxyacid and L is selected from the group consisting of:

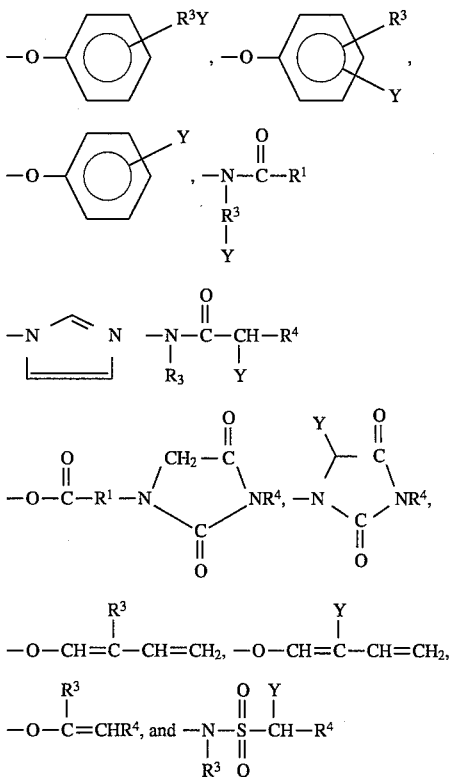

wherein $R^1$ is as defined for the peroxyacid, $R^3$ is an alkyl chain containing from about 1 to 8 carbon atoms, $R^4$ is H or $R^3$, and Y is H or a solubilizing group. The preferred solubilizing groups are $—SO_3—M^+$, $—COO—M^+$, $—SO_4—M^+$, $(—N^+R^3{}_4)X—$ and $O\ N(R^3{}_4)$ and most preferably $—SO_3—M^+$ and $—COO—M^+$ wherein $R^3$ is an alkyl chain containing from about 1 to about 4 carbon atoms, M is a cation which provides solubility to the peroxyacid bleach precursor, and X is an anion which provides solubility to the peroxyacid bleach precursor. Preferably, M is an alkali metal, ammonium or substituted ammonium cation, with sodium and potassium being most preferred, and X is a halide, hydroxide, methylsulphate or acetate anion. It should be noted that peroxyacid bleach precursors with a leaving group that does not contain a solubilizing group should be well dispersed in the bleaching solution in order to assist in their dissolution.

Preferred peroxyacid bleach precursors are those wherein L is a leaving group as previously defined, $R^1$ is an alkyl group containing from 6 to 12 carbon atoms, $R^2$ is an alkylene group containing from 4 carbon atoms to 8 carbon atoms, and $R^5$ is H, and L is selected from the group consisting of:

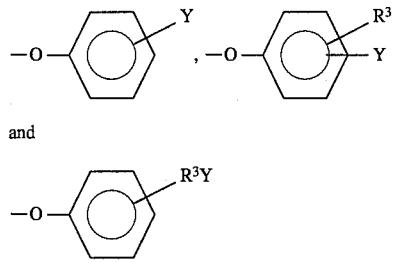

wherein $R^3$ is as defined above and Y is $—SO_3—M^+$ or $COO—M^+$ wherein M is as defined above.

Especially preferred peroxyacid bleach precursors are those wherein $R^1$ is a linear alkyl chain containing from 6 to 12 carbon atoms, $R^2$ is a linear alkylene chain containing from 4 to 8 carbon atoms, $R^5$ is H, and L is selected from the group consisting of:

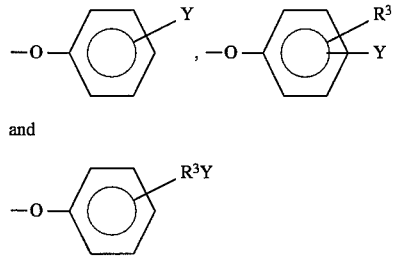

wherein $R^3$ is as defined above and Y is $—SO_3—M^+$ or $COO—M^+$ wherein M is as defined above.

For the purposes of the present invention, the peroxyacid bleaching compounds can be incorporated into detergent compositions without additional protection, but preferred embodiments of the invention utilise a coated form of material. Although a variety of coatings can be used, the most economical is sodium silicate of $SiO_2$:$Na_2O$ ratio from 1.6:1 to 2.8:1, preferably 2.0:1, applied as an aqueous solution to give a level of from 2% to 10%, (normally from 3% to 5%) of silicate solids by weight of the percarbonate. Magnesium silicate can also be used and a chelant such as one of those mentioned hereinbefore can also be included in the coating.

It has been found that the total level of free Iron, Copper and Manganese ions in the product should not exceed 40 ppm by weight of the composition and preferably should be less than 25 ppm in order to avoid an unacceptably adverse effect on peroxyacid bleach compound stability. In particular the level of free Iron ions should be less than 40 ppm by weight of the composition, more preferably less than 25 ppm, most preferably less than 20 ppm.

By free Iron, Copper and Manganese ions in the product it is meant those ions which, by virtue of their not being strongly complexed/bound by a ligand of high binding constant, are sufficiently mobile or labile to be available to act so as to catalyse decomposition of peroxyacid bleaching compounds in the product.

The free Iron, Copper and Manganese ions will, in general, be present as impurities in the detergent product. These impurities are essentially present in the product as a result of the incorporation of raw material components into the product which themselves contain high levels of free transition metal ions impurities. Examples of raw material components which may contain high levels of such transition metal ion impurities are sodium sulfate, sodium silicate and sodium carbonate. Iron impurity levels are often particularly high in these raw material components, and are desirably minimised when such raw materials are incorporated into the compositions of the inventions. The level of Iron, Copper and Manganese ion impurities in the raw material components incorporated into compositions in accord with the invention should be such as to provide less than 40 ppm in total by weight of the composition Iron, Copper and Manganese ions when incorporated into the compositions in accord with the invention.

Detergent components containing strongly bound/complexed transition metal ions may be incorporated into the compositions of the invention. These components in which the transition metal ion is strongly complexed will not, in general, have any adverse effect on the stability of the peroxyacid bleaching compounds present in the composition in that the metal ions are not labile, and therefore not available to catalyse decomposition of the bleach. Examples of detergent components containing strongly bound (and therefore not free) heavy metal ions include Cu-EDTA and the Mn-porphyrins. The binding constants (Kc) for Cu-EDTA at 298K is of the order of $10^{18}$, the transition metal ion hence being strongly complexed.

Compositions in accord with the invention may also contain additional bleaching components selected from oxygen bleaches, peroxyacid bleach precursors (bleach activators) and photoactivated bleaches. The additional bleaching components may be present in an amount of from 0% to 30% by weight of the composition.

The presence of these additional bleaching components is desirable in laundry detergent compositions for use in general laundering applications where the laundry load can include both white and coloured fabrics. However, in laundry detergent compositions designed for use in the specific application of 'colour-safe' laundering of coloured, and dyed fabrics it is deskable that these compositions contain no additional bleaching components.

Where one or more of the additional bleaching components is an oxygen bleach these are present in an amount of from 1% to 20%, more preferably from 5% to 15% and most preferably from 8% to 15% by weight of the composition. Where one or more of the additional bleaching components is a peroxyacid bleach precursor these are present in an amount of from 1% to 10%, more preferably from 2% to 6% by weight of the composition.

A preferred example of an oxygen bleach is a solid percarbonate bleach, normally in the form of the sodium salt.

Sodium percarbonate is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene 1,1-diphosphonic acid (HEDP) or an amino-phosphonate, that is incorporated during the manufacturing process. For the purposes of the present invention, the percarbonate can be incorporated into detergent compositions without additional protection, but preferred embodiments of the invention utilise a coated form of the material. Although a variety of coatings can be used, the most economical is sodium silicate of $SiO_2$:$Na_2O$ ratio from 1.6:1 to 2.8:1, preferably 2.0:1, applied as an aqueous solution to give a level of from 2% to 10%, (normally from 3% to 5%) of silicate solids by weight of the percarbonate. Magnesium silicate can also be used and a chelant such as one of those mentioned above can also be included in the coating.

The particle size range of the crystalline percarbonate is from 350 micrometers to 450 micrometers with a mean of approximately 400 micrometers. When coated, the crystals have a size in the range from 400 to 600 micrometers.

Other suitable oxygen bleaches include the inorganic perhydrates such as sodium perborate monohydrate and tetrahydrate sodium perphosphate and sodium persilicate. Of these, the sodium perborate salts are the most preferred.

Photoactivated bleaches include the zinc and aluminium salts of tri and tetra sulphonated phthalocyanine which are normally added as dispersions in other materials because of their low levels of usage, typically from 0.0005 to 0.01% by weight of composition.

Peroxyacid bleach precursors (bleach activators) as additional bleaching components in accord with the invention can be selected from a wide range of classes and are preferably those containing one or more N- or O- acyl groups.

Suitable classes include anhydrides, esters, amides and acylated derivatives of imidazoles and oximes, and examples of useful materials within these classes are disclosed in GB-A-1586789. The most preferred classes are esters such as are disclosed in GB-A-836 988, 864 798, 1 147 871 and 2 143 231 and amides such as are disclosed in GB-A-855 735 and 1 246 338.

Particularly preferred precursor compounds as additional bleaching components in accord with the invention are the N-,N,$N^1N^1$ tetra acetylated compounds of formula

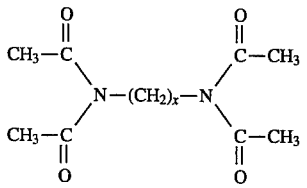

where x can be or an integer between 1 and 6.

Examples include tetra acetyl methylene diamine (TAMD)in which x=1, tetra acetyl ethylene diamine (TAED) in which x=2 and Tetraacetyl hexylene diamine (TAHD) in which x=6. These and analogous compounds are described in GB-A-907 356. The most preferred peroxyacid bleach precursor as an additional bleaching component is TAED. Levels of incorporation range from 1% to 10% more preferably from 2% to 6% by weight of the composition.

Solid peroxyacid bleach precursors useful as additional bleaching components in compositions of the present invention have a melting point >30° C. and preferably >40° C. Such precursors will normally be in fine powder or crystalline form in which at least 90% by weight of the powder has a particle size >150 micrometers.

Compositions in accordance with the invention can also contain up to 67% of non-surfactant non detergent builder components as optional ingredients. Anti-redeposition and soil-suspension agents, optical brighteners, soil release agents, dyes and pigments are examples of such optional ingredients and can be added in varying amounts as desired.

Anti-redeposition and soil-suspension agents suitable herein include cellulose derivatives such as methylcellulose, carboxymethylcellulose and hydroxyethylcellulose, and homo- or co-polymeric polycarboxylic acids or their salts. Polymers of this type include copolymers of maleic anhydride with ethylene, methylvinyl ether or methacrylic acid, the maleic anhydride constituting at least 20 mole percent of the co-polymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino-s-triazin-6-ylamino) stilbene-$2:2^1$ disulphonate, disodium $4,4^1$-bis-(2-morpholino-4-anilino-s-triazin-6-ylaminostilbene-$2:2^1$-disulphonate, disodium $4,4^1$-bis-(2,4-dianilino-s-triazin-6-ylamino)stilbene-$2:2^1$-disulphonate, monosodium $4^1.4^{11}$-bis-(2,4-dianilino-s-triazin-6 ylamino)stilbene-2-sulphonate, disodium $4,4^1$-bis-(2-anilino-4-(N-methyl-N-2-hydroxethylamino)-s-triazin- 6-ylamino)stilbene-$2,2^1$-disulphonate, disodium $4,4^1$-bis-(4-phenyl-2,1,3-triazol-2-yl)-stilbene-$2,2^1$ disulphonate, disodium $4,4^1$bis(2-anilino-4-(1-methyl-2-hydroxyethylamino)-s-triazin-6-ylamino) stilbene-$2,2^1$disulphonate and sodium 2(stilbyl-$4^{11}$-naptho-$1^1,2^1$:4,5)-1,2,3-triazole-$2^{11}$-sulphonate.

Soil-release agents useful in compositions of the present invention are conventionally co-polymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0272033. A particular preferred polymer in accordance with EP-A-0272033 has the formula $(CH_3(PEG)_{43})_{0.75}$ $(POH)_{0.25}[(T\text{-}PO)_{2.8}$ $(T\text{-}PEG)_{0.4}]T(PO\text{-}H)_{0.25}((PEG)_{43}CH_3)_{0.75}$ where PEG is $—(OC_2H_4)O—$, PO is $(OC_3H_6O)$ and T is $(pCOC_6H_4CO)$.

Certain polymeric materials such as polyvinyl pyrrolidones typically of melting point 5000–20000, preferably 10000–15000, also form useful agents in preventing the transfer of labile dyestuffs between fabrics during the washing process.

Another optional ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range form about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC-544, commercially available from Dow Corning, which is a siloxane/glycol co-polymer.

The suds suppressors described above are normally employed at levels of form 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt co-polymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellases conventionally incorporated into detergent compositions. Suitable enzymes are discussed in U.S. Pat. No. 3,519,570 and 3,533,139.

Fabric softening agents can also be incorporated into detergent compositions in accordance With the present invention. These agents may be inorganic or organic in type. Inorganic softening agents are exemplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0027527 & EP-B-0027528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from 5% to 15%, more preferably form 8% to 12% by weight, with the material being added as a dry mixed component to-the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray-dried, these materials can be added to the aqueous slurry fed to the spray drying tower, although in some instances it may be more convenient to add them as a dry mixed particulate, or spray them as a molten liquid on to other solid components of the composition.

A feature of the compositions of the present invention is that they are of relatively high density in comparison with conventional laundry detergent compositions. Such high density compositions have become known as concentrated products and are characterised by a bulk density of at least 650 g/liter, more usually at least 700 g/liter and more preferably in excess of 800 g/liter. Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500ml.

To carry out a measurement, the funnel is filled with powder by hand pouring, the flap valve is opened and powder allowed to overfill the cup. The filled cup is removed from the frame and excess powder removed from the cup by passing a straight edged implement, e.g. a knife, across its upper edge. The filled cup is then weighed and the value obtained for the weight of powder doubled to provide the bulk density in g/liter. Replicate measurements are made as required.

Another feature of compositions of the present invention is that they incorporate at least one multi-ingredient component, i.e. they do not comprise compositions formed merely by dry-mixing individual ingredients. Compositions in which each individual ingredient is dry-mixed are generally dusty, slow to dissolve and also tend to cake and develop poor particle flow characteristics in storage.

Subject to the above bulk density and component content limitations, the compositions of the invention can be made via a variety of methods including dry mixing, spray-drying, agglomeration and granulation and preferred methods involve combinations of these techniques. A preferred method of making the compositions involves a combination of spray-drying, agglomeration in a high speed mixer and dry mixing.

Preferred detergent compositions in accordance with the invention comprise at least two particulate multi-ingredient components. The first component comprises at least 15%, conventionally from 25% to 50%, but more preferably no more than 35% by weight of the composition and the second component from 1% to 50%, more preferably 10% to 40% by weight of the composition.

The first component comprises a particulate incorporating an anionic surfactant in an amount of from 0.75 % to 40% by weight of the powder and one or more inorganic and/or organic salts in an amount of from 99.25% to 60% by weight of the powder. The particulate can have any suitable form such as granules, flakes, prills, marumes or noodles but is preferably granular. The granules themselves may be agglomerates formed by pan or drum agglomeration or by in-line mixers but are customarily spray-dried particles produced by atomising an aqueous slurry of the ingredients in a hot air stream which removes most of the water. The spray-dried granules are then subjected to densification steps, e.g. by high speed cutter mixers and/or compacting mills, to increase density before being reagglomerated. For illustrative purposes, the first component is described hereinater as a spray-dried powder.

Suitable anionic surfactants for the purposes of the first component have been found to be slowly dissolving linear alkyl sulphate salts in which the alkyl group has an average of from 16 to 22 carbon atoms, and linear alkyl carboxylate salts in which the alkyl group has an average of from 16 to 24 carbon atoms.

The alkyl groups for both types of surfactant are preferably derived from natural fats such as tallow. Shorter chain alkyl sulphates or carboxylates, in which the alkyl group is derived from sources comprising a mixture of alkyl moieties more than 40% of which contain 14 or less carbon atoms, are less suitable as they cause the first component to form a gel like mass during dissolution.

The level of anionic surfactant in the spray-dried powder forming the first component is from 0.75% to 40% by weight, more usually 2.5% to 25% preferably from 3% to 20% and most preferably from 5% to 15% by weight. Water-soluble surfactants such as linear alkyl benzene sulphonates or $C_{14}$–$C_{15}$ alkyl sulphates can be included or alternatively may be applied subsequently to the spray-dried powder by spray on.

The other major ingredient of the spray-dried powder is one or more inorganic or organic salts that provide the crystalline structure for the granules. The inorganic and/or organic salts may be water-soluble or water-insoluble, the latter type being comprised by the, or the major part of the, water-insoluble builders where these form part of the builder ingredient. Suitable water soluble inorganic slats include the alkali metal carbonates and bicarbonates. Alkali metal silicates other than crystalline layered silicates can also be present in the spray-dried granule provided that aluminosilicate does not form part of the spray-dried component.

However, for the purposes of the present invention it is preferred that water-soluble sulphate, particularly sodium sulphate, should be present at a level of more than 2.5% by weight of the composition. Preferably no sodium sulphate is added as a separate ingredient and its incorporation as a by-product, e.g. with-sulph(on)ated surfactants, should be miniraised.

Where an aluminosilicate zeolite forms the, or part of the, builder ingredient, it is preferred that it is not added directly by dry-mixing to the other components, but is incorporated into the multi-ingredient component(s). Where incorporation of the zeolite takes place in the spray-dried granule, any silicate present should not form part of the spray-dried granule. In these circumstances incorporation of the silicate can be achieved in several ways, e.g. by producing a separate silicate-containing spray-dried particulate, by incorporating the silicate into an agglomerate of other ingredients, or more preferably by adding the silicate as a dry mixed solid ingredient.

The first component can also include up to 15% by weight of miscellaneous ingredients such as brighteners, anti-redeposition agents and heavy metal sequestering agents. Where the first component is a spray-dried powder it will normally be dried to a moisture content of from 7% to 11% by weight, more preferably from 8% to 10% by weight of the spray-dried powder. Moisture contents of powders produced by other processes such as agglomeration may be lower and can be in the range 1–10% by weight.

The particle size of the first component is conventional and preferably not more than 5% by weight should be above 1.4 mm, while not more than 10% by weight should be less than 0.15 mm in maximum dimension. Preferably at least 60%, and most preferably at least 80%, by weight of the powder lies between 0.7 mm and 0.25 mm in size. For spray-dried powders, the bulk density of the particles from the spray-drying tower is conventionally in the range from 540 to 600 g/liter and this is then enhanced by further processing steps such as size reduction in a high speed cutter/mixer followed by compaction. Alternatively, processes other than spray-drying may be used to form a high density particulate directly.

A second component of a preferred composition in accordance with the invention is another multi-ingredient particulate containing a water soluble surfactant.

This may be anionic, nonionic, ationic or semipolar in type or a mixture of any of these. Suitable surfactants are listed hereinbefore but preferred surfactants are $C_{14}$–$C_{15}$ alkyl sulphates linear $C_{11}$–$C_{15}$ alkyl benzene sulphonates and fatty $C_{14}$–$C_{18}$ methyl ester sulphonates.

The second component may have any suitable physical form, i.e. it may take the form of flakes, prills, marumes, noodles, ribbons, or granules which may be spray-dried or non spray-dried agglomerates. Although the second component could in theory comprise the water soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

The particle size range of the second component is not critical but should be such as to obviate segregation from the particles of the first component when blended therewith. Thus not more than 5% by weight should be above 1.4 mm while not more than 10% should be less than 0.15 mm in maximum dimension.

The bulk density of the second component will be a function of its mode of preparation. However, the preferred form of the second component is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige Maschinenban GmbH, D-4790 Paderborn 1, Elsenerstrasse 7–9, Postfach 2050 F.R.G. By this means the second component can be given a bulk density in the range from 650 g/liter to 1190 g/liter more, preferably from 750 g/liter to 850 g/liter.

Preferred compositions include a level of alkali metal carbonate in the second component corresponding to an amount of from 3% to 15% by weight of the composition, more preferably from 5% to 12% by weight. This will provide a level of carbonate in the second component of from 20% to 40% by weight.

A highly preferred ingredient of the second component is also a hydrated water insoluble aluminosilicate ion exchange material of the synthetic zeolite type, described hereinbefore, present at from 10% to 35% by weight of the second component. The amount of water insoluble aluminosilicate material incorporated in this way is from 1% to 10% by weight of the composition, more preferably from 2% to 8% by weight.

In one process for preparing the second component, the surfactant salt is formed in situ in an in-line mixer. The liquid acid form of the surfactant is added to a mixture of particulate anhydous sodium carbonate and hydrated sodium aluminosilicate in a continuous high speed blender such as a Lodige KM mixer and neutralised to form the surfactant salt whilst maintaining the particulate nature of the mixture. The resultant agglomerated mixture forms the second component which is then added to other components of the product. In a variant of this process, the surfactant salt is pre-neutralised and added as a viscous paste to the mixture of the other ingredients. In this variant, the mixer serves merely to agglomerate the ingredients to form the second component.

In a particularly preferred process for making compositions in accordance with the invention, part of the spray-dried product comprising the first granular component is diverted and subjected to a low level of nonionic surfactant spray on before being reblended with the remainder. The second granular component is made using the preferred process described above. The first and second components together with other dry mix ingredients such as any carboxylate chelating agent, the sodium percarbonate bleach, bleach activator, soil-release polymer, silicate of conventional or crystalline layered type and enzyme are then fed to a conveyor belt, from which they are transferred to a horizontally rotating drum in which perfume and silicone suds suppressor are sprayed on to the product. In highly preferred compositions, a further drum mixing step is employed in which a low (approx. 2% by weight) level of finely divided crystalline material is introduced to increase density and improve granular flow characteristics. This material should not however be an aluminosilicate zeolite builder as it has been found that zeolite builders present in discrete particulate form in the product have an adverse effect on percarbonate stability.

Compositions in accordance with the invention can also benefit from delivery systems that provide transient localised high concentrations of product in the drum of an automatic washing machine at the start of the wash cycle, thereby also avoiding problems associated with loss of product in the pipework or sump of the machine.

Delivery to the drum an most easily be achieved by incorporation of the composition in a bag or container from which it is rapidly releasable at the start of the wash cycle in response to agitation, a rise in temperature or immersion in the wash water in the drum. Alternatively the washing machine itself may be adapted to permit direct addition of the composition to the drum, e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

In a variant of the bag or container product form, laminated sheet products can be employed in which a central flexible layer is impregnated and/or coated with a composition and then one or more outer layers are applied to produce a fabric-like aesthetic effect. The layers may be sealed together so as to remain attached during use or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water.

The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable material which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing cycle. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

The invention is illustrated in the following non limiting Examples, in which all percentages are on a weight basis unless otherwise stated.

In detergent compositions, the abbreviated component identifications have the following meanings:

$C_{12}$LAS: Sodium linear $C_{12}$ alkyl benzene sulphonate

TAS: Sodium tallow alcohol sulphate $TAE_n$: Tallow alcohol ethoxylated with n moles of ethylene oxide per mole of alcohol 45E7: A $C_{14}$–$C_{15}$ predominantly linear primary alcohol condensed with an average of 7 moles of ethylene oxide Silicate: Amorphous sodium silicate ($SiO_2$:$Na_2O$ ratio normally follows)

Carbonate: Anhydrous sodium carbonate

CMC: Sodium carboxymethyl cellulose

Zeolite A: Hydrated sodium aluminosilicate of formula $Na_{12}(AlO_2SiO_2)_{12}.27\ H_2O$ having a primary particle size—the range from 1 to 10 micrometers Citrate: Tri-sodium citrate dihydrate Photoactivated: Tetra sulphonated zinc Bleach phthalocyanine MA/AA: Copolymer of 1:4 maleic/acrylic acid, average molecular weight about 80,000

Perborate: Sodium perborate tetrahydrate of nominal formula $NaBO_2.3H_2O.H_2O_2$ Enzyme: Mixed proteolytic and amylolytic enzyme sold by Novo Industrie AS Brightener: Disodium 4,4'-bis(2-morpholino-4-anilino-s-trazin-6-ylamino)stilbene-2:2'-disulphonate DETPMP: Diethylene triamine penta (methylene phosphonic acid), marketed by Monsanto under the Trade name Dequest 2060

Mixed Suds 25% paraffin wax Mpt 50° C., Suppressor 17% hydrophobic silica, 58% paraffin oil NAPAA:Nonyl Amido Peroxy Adipic Acid Iron, Manganese, Copper: Free heavy metal ion contamination levels Sulphate: Sodium sulphate

EXAMPLE 1

Detergent products were prepared with the following compositions by weight. Product B is in accordance with the invention, while product A is a comparative product:

| | A | B |
|---|---|---|
| $C_{12}$LAS | 6.80 | 6.80 |
| TAS | 2.20 | 2.20 |
| 45E7 | 3.26 | 3.26 |
| TAE11 | 1.00 | 1.00 |
| Zeolite A | 22.18 | 22.18 |
| Silicate, $SiO_2$:$Na_2O$ = 2.0:1 | 3.50 | 3.50 |
| Citrate | 8.00 | 8.00 |
| MA/AA | 4.70 | 4.70 |
| Carbonate | 16.50 | 16.50 |
| Perborate | 10.00 | 10.00 |
| NAPAA | 2.00 | 2.00 |
| DETPMP | 0.19 | 0.19 |
| Enzyme | 1.40 | 1.40 |
| CMC | 0.48 | 0.48 |
| Photoactivated Bleach | 20 ppm | 20 ppm |
| Brightener | 0.24 | 0.24 |
| Mixed Suds Suppressor | 0.49 | 0.49 |
| Perfume | 0.43 | 0.43 |
| Miscellaneous | 2.40 | 2.40 |
| Moisture* | 6.00 | >4.00 |
| Iron | 20.5 ppm | 20.5 ppm |
| Manganese | 2 ppm | 2 ppm |
| Copper | 2 ppm | 2 ppm |
| Sulphate | 1.00 max | 1.00 max |
| Density g/liter | 700 | 700 |
| Equilibrium Relative Humidity RH (%) | 34 | 20 |

*'Moisture' - for product A this is free and bound moisture. For product B this is essentially bound moisture.

'Moisture'- for product A this is free and bound moisture. For product B this is essentially bound moisture.

Product A was made by a combination of spray-drying, agglomeration and dry mixing techniques. A spray-dried powder was made incorporating all of the TAS, approximately one quarter of the LAS, all of the maleic anhydride/acrylic acid copolymer, DETPMP, CMC and brightener and approximately 80% of the zeolite builder. The spray-dried product was passed through a Lodige KM high speed mixer/cutter, following which the 45E7 nonionic was sprayed on to the granules. The treated granules were then transferred to a conveyor belt. The bulk of the remainder of the LAS and zeolite together with approximately 30% of the carbonate were processed in a Lodige KM high speed mixer to form agglomerated particles which were fed to the conveyor belt. The other dry solid ingredients viz. the citrate, silicate and the remainder of the carbonate were also added to the belt at the same time. Finally the mixed particulates were subjected to a low intensity blending step in a mix drum, during which step the perfume and suds suppressor were sprayed on to the particulates to form a nil-bleach product.

The nil-bleach product was then divided into two equal parts. To the first part of this nil-bleach product were added the perborate and NAPAA containing particles of 35–50% activity. These NAPAA containing particles also contained sodium sulphate and minor amounts of LAS as processing/bulking agents and took the physical form of extruded prills. This product, denoted product A, had an Equilibrium Relative Humidity, measured as hereinbefore described, of 34%.

The second part of the nil-bleach product was then placed in a vacuum oven at 60° C. for 18 hours during which time the free moisture in the product was driven off thus reducing the total moisture content by 2– 3%. To this portion of the nil-bleach product were added the perborate and the NAPAA containing particles as with product A to give product B with an Equilibrium Relative Humidity of 20% in accord with the invention. The products A & B were then placed in storage at 32° C. and 80% RH in separate closed wax laminated cardboard cartons and determinations were made of the amount of peroxyacid (NAPAA) remaining undecomposed in the products after 0, 2, 4, 6, and 8 weeks. Four weeks storage under these conditions is believed to correlate with storage for at least 6 months under Southern European summer conditions.

The amount of NAPAA remaining undecomposed in the products was determined as now described. A 10 g sample was removed using a Pascal sampling device and the samples analysed for NAPAA content using the standard thiosulphate/iodide analytical method described hereinafter. This procedure was repeated on each sampling date until consistent results for the amount of NAPAA content were obtained.

The thiosulphate/iodide analytical method is a well known method for determining peroxyacid levels in a product. The 10 g sample is dissolved in 60 ml acetic acid and stirred on a hotplate for 5 minutes. This solution is then rinsed into a beaker containing 500 ml distilled water at 20° C. and stirred for at least 2 minutes at 180 rpm to ensure even mixing. A 10 ml aliquot is taken and placed in a titration beaker containing 15 ml acetic acid and 10 ml water maintained at around 0° C. by placing in an ice bath. 5 ml of 1% potassium iodide is added to the contents of this titration beaker just prior to titration. This solution was titrated with 0.002N sodium thiosulphate according to the standard thiosulphate/iodide analytical method.

The results were as follows, expressed as % of the original amount of NAPAA present. The error limits at the 95% confidence level amount to no more than ±6%.

| | 2 weeks | 4 weeks | 6 weeks | 8 weeks |
|---|---|---|---|---|
| A | 88 | 57 | 35 | 12 |
| B | 100 | 87 | 72 | 56 |

It can be seen that Product B in accordance with the invention displays acceptable peroxyacid stability under the stated storage conditions, whereas the comparison product A does not have an acceptable peroxyacid (NAPAA) stability.

We claim:

1. A solid laundry detergent composition, comprising by weight:

a) from 5% to 30% of one or more surfactants;

b) from 15% to 80% of one or more non-phosphate detergent builder salts;

c) from 1% to 15% of one or more bleaching compounds which provide in an aqueous solution an amide substituted peroxyacid bleaching compound of the formula:

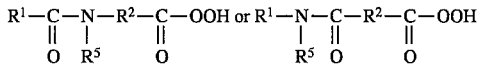

wherein $R^1$ is an alkyl, aryl or alkaryl group containing from 1 to 14 carbon atoms, $R^2$ is an alkylene, arylene or alkarylene group containing from 1 to 14 carbon atoms, and $R^5$ is H or an alkyl, aryl or alkaryl group containing from 1 to 10 carbon atoms;

d) from 0% to 30% of additional bleaching components selected from oxygen bleaches, peroxyacid bleach precursors and photoactivated bleaches;

e) from 0% to 67% of detergent ingredients other than those in a) to d)

wherein the composition i) has a bulk density of at least 650 g/liter, and comprises at least one multi-ingredient component;

ii) contains less than 40 ppm total of free Iron, Copper and Manganese ions; and iii) has an Equilibrium Relative Humidity of not more than 30% at 32° C., whereby the weight percentage of the original one or more bleaching compounds remaining undecomposed after 28 days storage in closed wax laminated paperboard cartons at 32° C. and 80% Relative Humidity is at least 60%.

2. A detergent composition according to claim 1 wherein one or more of the bleaching compounds is a preformed peroxyacid of formula:

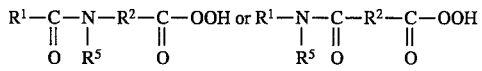

wherein $R^1$, $R^2$ and $R^5$ are as defined in claim 1.

3. A detergent composition according to claim 1 wherein one or more of the bleaching compounds is a magnesium peroxycarboxylate of the following general formulae:

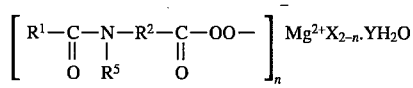

or

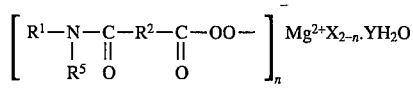

wherein $R^1$, $R^2$ and $R^5$ are as defined in claim 1 wherein X is a compatible anion, n is 1 or 2, and Y is from 0 to 6.

4. A detergent composition according to claim 1 wherein one or more of the bleaching compounds is obtained from a bleach activator of the general formula:

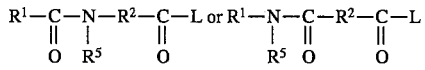

wherein $R^1$ is an alkyl, aryl or alkaryl group containing from 1 to 14 carbon atoms, $R^2$ is an alkylene, arylene or alkarylene group containing from 1 to 14 carbon atoms, and $R^5$ is H or an alkyl, aryl or alkaryl group containing from 1 to 10 carbon atoms, and L is a leaving group.

5. A detergent composition according to claim 1 wherein $R^1$ is an alkyl group containing from 6 to 12 carbon atoms, $R^2$ is an alkylene group containing from 4 to 8 carbon atoms, and $R^5$ is H or methyl.

6. A composition according to claim 1 wherein the Equilibrium Relative Humidity is not more than 25% at 32° C.

7. A composition according to claim 1 wherein one additional bleaching component is tetra acetyl ethylene diamine (TAED) in an amount from 2% to 6% by weight of the composition.

8. A composition according to claim 1 wherein one or more of the bleaching compounds is coated.

9. A composition according to claim 8 wherein the coating comprises sodium silicate in an amount of from 2% to 5% by weight of the bleaching compound(s).

10. A composition according to claims 8 wherein the weight percentage of the original bleaching compound(s) remaining unclecomposed after 28 days storage in closed wax laminated paperboard cartons at 32° C. and 80% Relative Humidity is at least 80%.

11. A composition according to claim 1 containing not more than 2.5% by weight of sodium sulphate.

12. A composition according to claim 1 wherein any sodium sulphate present is not in the form of a separately added ingredient.

13. A solid laundry detergent composition according to claim 1 wherein one multi-component ingredient comprises a spray-dried powder.

14. A solid laundry detergent composition according to claim 1 wherein one multi-ingredient component comprises an agglomerate of non-spray-dried ingredients.

15. A composition according to claim 14 incorporating at least one agglomerate and also spray-dried powder, each containing a proportion of both ingredients a) and b) and optionally one or more ingredients (e).

16. A composition according to claim 1 wherein the non-phosphate detergent builder ingredient is selected from alkali metal carbonates, bicarbonates, silicates, aluminosilicates, polycarboxylates, amino poly (alkylene phosphonates) and mixtures thereof.

17. A composition according to claim 1 wherein the non-phosphate detergent builder ingredient is completely water-soluble.

18. A composition according to claim 1 wherein the non-phosphate detergent builder ingredient is a mixture of water-soluble and water-insoluble compounds.

19. A composition according to claim 18 wherein the non-phosphate detergent builder ingredient includes a sodium aluminosilicae zeolite of formula $Na_z[(AlO_2)_z(SiO_2)_y]xH_2O$ wherein z and y are at least 6, the ratio of z to y is form 1.0 to 0.5 and x is at least 5, preferably from 7.5 to 27.6, said zeolite being present solely as part of one or more multi-ingredient compounds.

20. A composition according to claim 16 wherein said non-phosphate detergent builder comprises sodium silicate having a ratio of $SiO_2$ to $Na_2O$ of from 1.6 to 3.0, said sodium silicate being present in a form that is discrete relative to any sodium aluminosilicate present in the composition.

21. A composition according to claim 20 wherein the non-phosphate detergent builder ingredient comprises a mixture of hydrated sodium zeolite A, sodium silicate, tri-sodium citrate dihydrate and sodium carbonate, optionally together with an alkali metal alkylene amino (poly alkylene phosphonate).

22. A composition according to claim 20 wherein the sodium silicate is a solid at ambient temperatures and is present as a discrete particulate.

23. A composition according to claim 22 wherein the sodium silicate is a crystalline layered silicate of formula $NaMSi_xO_{22+1}yH_2O$ wherein M is sodium or hydrogen, x is a number from 1.9 to 4 and y is a number from 0 to 20.

24. A composition according to claim 23 wherein M is Na, x is 2 and y is 0.

* * * * *